US010700456B2

(12) United States Patent
Song et al.

(10) Patent No.: US 10,700,456 B2
(45) Date of Patent: Jun. 30, 2020

(54) BOARD-MATING CONNECTOR WITH REDUCED COUPLING HEIGHT

(71) Applicant: GigaLane Co., Ltd., Hwaseong-si, Gyeonggi-do (KR)

(72) Inventors: Hwa Yoon Song, Hwaseong-si (KR); Sang Min Seo, Hwaseong-si (KR); Eun Jung Kim, Hwaseong-si (KR); Jin Uk Lee, Hwaseong-si (KR); Kyung Hun Jung, Hwaseong-si (KR); Hee seok Jung, Hwaseong-si (KR)

(73) Assignee: GIGALANE CO., LTD., Hwaseong-si, Gyeonggi-Do (KR)

( * ) Notice: Subject to any disclaimer, the term of this patent is extended or adjusted under 35 U.S.C. 154(b) by 0 days.

(21) Appl. No.: 16/441,047

(22) Filed: Jun. 14, 2019

(65) Prior Publication Data

US 2020/0021049 A1 Jan. 16, 2020

(30) Foreign Application Priority Data

Jul. 10, 2018 (KR) ..... 10-2018-0080103
Aug. 1, 2018 (KR) ..... 10-2018-0089973

(51) Int. Cl.
*H01R 12/71* (2011.01)
*H01R 12/70* (2011.01)
(Continued)

(52) U.S. Cl.
CPC ..... *H01R 12/714* (2013.01); *H01R 12/52* (2013.01); *H01R 12/7023* (2013.01); *H01R 24/52* (2013.01)

(58) Field of Classification Search
CPC .. H01R 12/714; H01R 12/7023; H01R 24/52; H01R 12/52; H01R 12/716; H01R 13/22;
(Continued)

(56) References Cited

U.S. PATENT DOCUMENTS 5,928,000 A * 7/1999 Rudisill ..... H01R 13/2407 439/63
6,231,352 B1 * 5/2001 Gonzales ..... H01R 12/52 439/66
(Continued)

FOREIGN PATENT DOCUMENTS

JP 05055481 U 7/1993
JP H07336115 A 12/1995
(Continued)

*Primary Examiner* — Travis S Chambers
(74) *Attorney, Agent, or Firm* — Brundidge & Stanger, P.C.

(57) ABSTRACT

A board-mating connector with a reduced coupling height includes a signal portion having one side in contact with a signal electrode of a board and to be electrically connected to the signal electrode; a ground portion having one side in contact with a ground electrode of the board to be electrically connected to the ground electrode and having a hollow inside; a housing portion in which a housing insertion hole is formed such that the signal portion and the ground portion are inserted thereinto and in which at least a part of a portion coming into contact with the ground portion is formed of metal; and a dielectric portion which is inserted into the housing insertion hole and is located between the signal portion and the housing portion such that the signal portion is spaced apart from the ground portion and the housing portion.

13 Claims, 7 Drawing Sheets

200(210,220,230)

(51) Int. Cl.
*H01R 24/52* (2011.01)
*H01R 12/52* (2011.01)

(58) Field of Classification Search
CPC .... H01R 13/24; H01R 13/2435; H01R 13/74; H01R 13/6596
USPC ..... 439/775, 65, 66, 74, 86, 91, 544, 560, 439/564, 572, 562, 607.28, 939
See application file for complete search history.

(56) References Cited

U.S. PATENT DOCUMENTS 6,354,855 B2 * 3/2002 Annequin ..... H01R 13/74 439/248
6,607,400 B1 8/2003 Ko
6,758,680 B2 * 7/2004 Duquerroy ..... H01R 24/50 439/63
8,105,092 B2 * 1/2012 Weidner ..... H01R 24/50 439/581
8,382,488 B2 * 2/2013 Uesaka ..... H01R 13/2421 439/581
8,690,583 B2 * 4/2014 Uesaka ..... H01R 12/714 439/63
9,583,854 B2 * 2/2017 Uesaka ..... G01R 1/0416
10,483,669 B2 * 11/2019 Petit ..... H01R 13/514
2003/0060069 A1 * 3/2003 Duquerroy ..... H01R 24/50 439/188
2011/0254575 A1 * 10/2011 Uesaka ..... H01R 12/714 324/754.11
2015/0270635 A1 9/2015 Wollitzer et al.

FOREIGN PATENT DOCUMENTS

JP H08504056 A 4/1996
JP H08236227 A 9/1996
JP H08335483 A 12/1996

* cited by examiner

【FIG. 1】
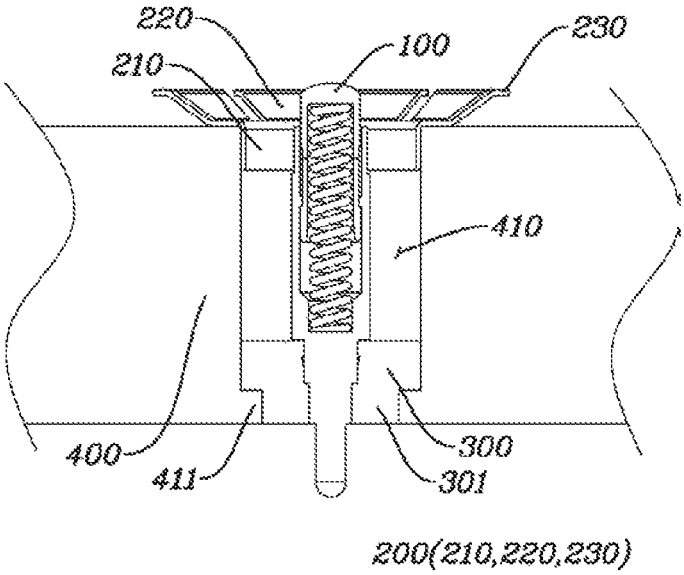
【FIG. 2】
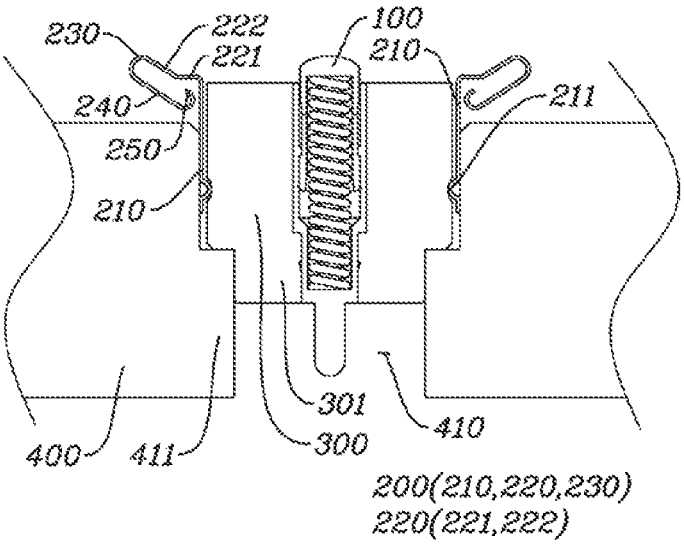

【FIG. 3】
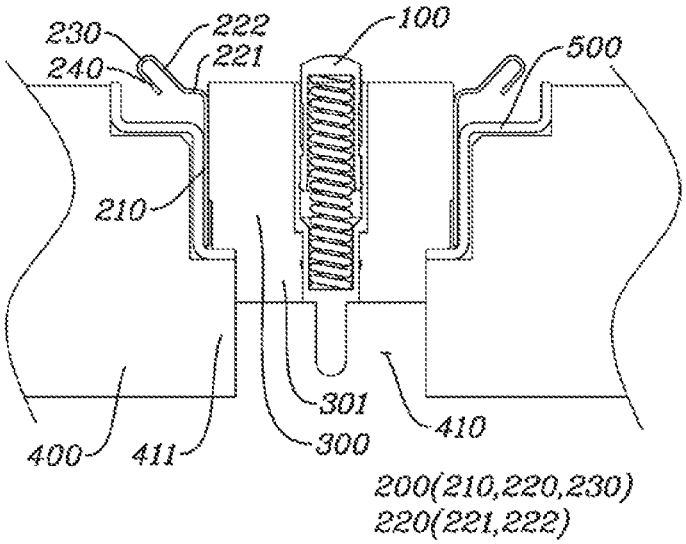
【FIG. 4】
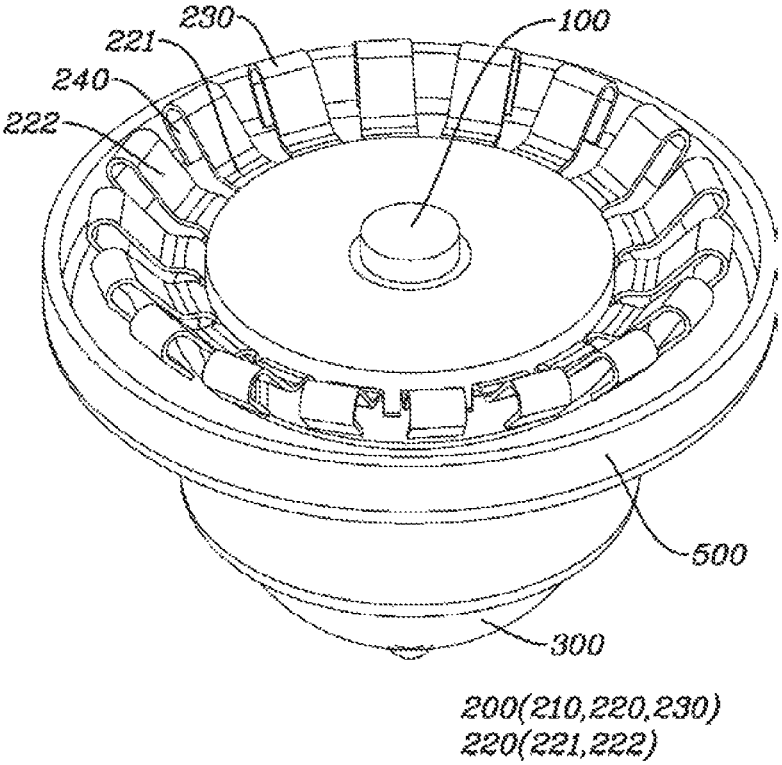

【FIG. 5】
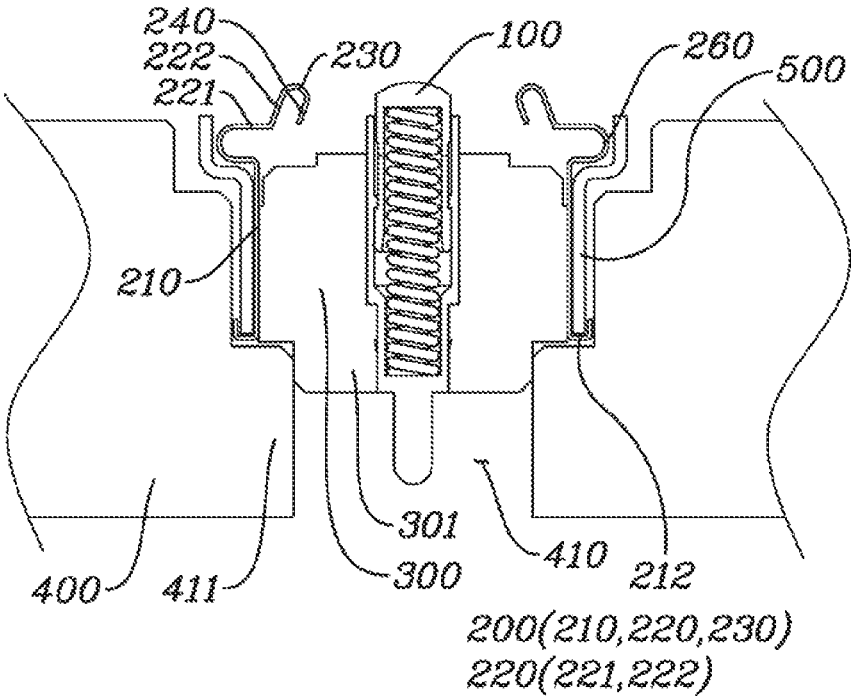

【FIG. 6】
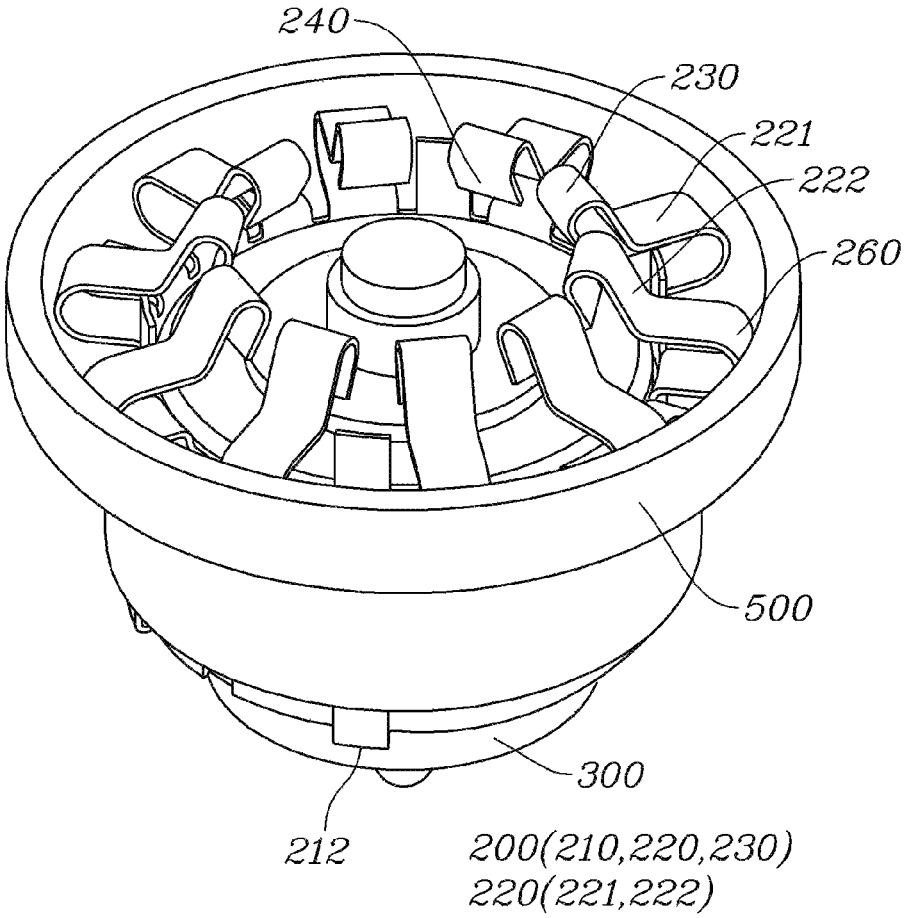

【FIG. 7】
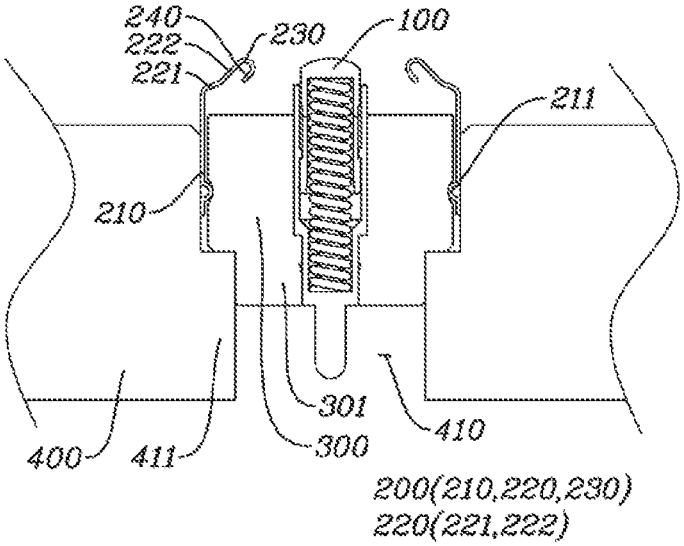
【FIG. 8】
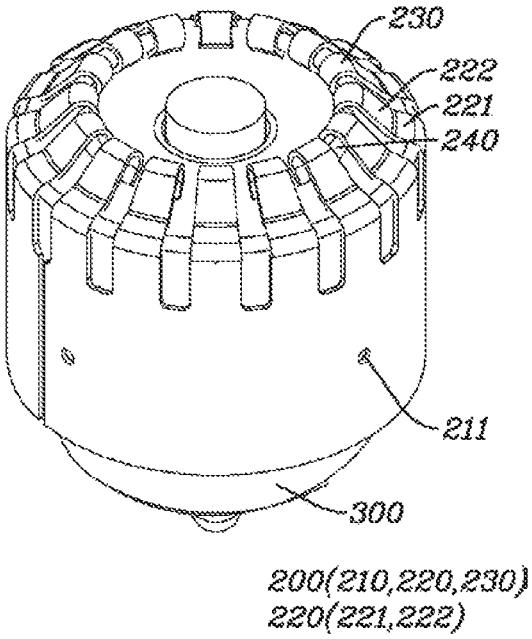

【FIG. 9】
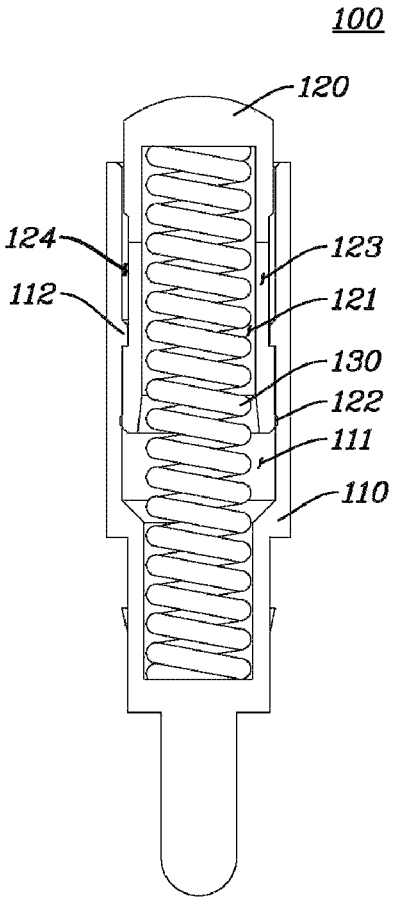

【FIG. 10】
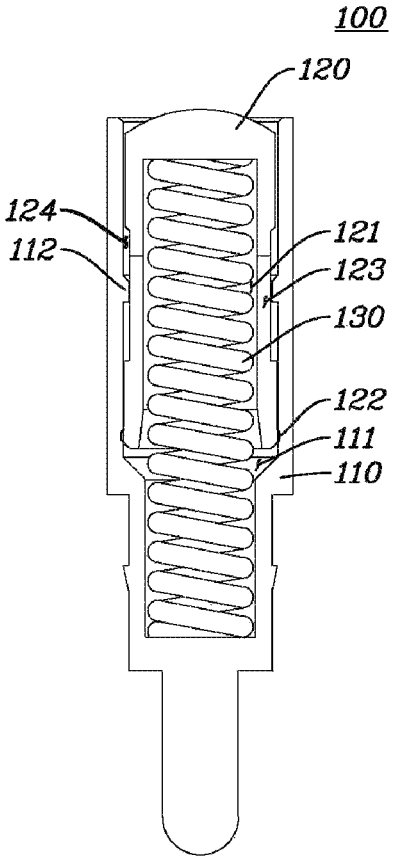

BOARD-MATING CONNECTOR WITH REDUCED COUPLING HEIGHT

CROSS-REFERENCE TO RELATED APPLICATIONS

This application claims the benefit under 35 U.S.C. § 119 of Korean Patent Application No. 10-2018-0080103 filed on Jul. 10, 2018 and Korean Patent Application No. 10-2018-0089973 filed on Aug. 1, 2018 in the Korean Intellectual Property Office. The disclosures of both applications are hereby incorporated herein by reference in their entireties.

TECHNICAL FIELD

The present invention relates to a board-mating connector with a reduced coupling height.

BACKGROUND ART

A board-mating connector transmits an RF signal to a board between an upper board and a lower board, which are formed with signal wires, such as printed circuit boards.

The board-mating connector increases a coupling height between the upper board and the lower board, and thereby, there is a problem that a thickness of a module including the board-mating connector is increased.

In addition, when a signal portion of the board-mating connector transmits the RF signal through a signal spring, there is a problem that passive inter-modulation distortion (PIMD) characteristics are poor.

Examples of related art include KR 10-2015-0080486 A, KR 10-1326296 B1, KR 10-1408249 B1, and KR 10-1855133 B1.

SUMMARY

The present invention is to provide a board-mating connector with a reduced coupling height.

A board-mating connector with a reduced coupling height according to the present invention includes a signal portion having one side in contact with a signal electrode of a board and to be electrically connected to the signal electrode; a ground portion having one side in contact with a ground electrode of the board to be electrically connected to the ground electrode and having a hollow inside; a housing portion in which a housing insertion hole is formed such that the signal portion and the ground portion are inserted thereinto and in which at least a part of a portion coming into contact with the ground portion is formed of metal; and a dielectric portion which is inserted into the housing insertion hole and is located between the signal portion and the housing portion such that the signal portion is spaced apart from the ground portion and the housing portion.

The board-mating connector may further include a protrusion bump which is formed to protrude from the housing portion toward an inside of the housing insertion hole; and a hook bump which is formed by reducing a diameter of a lower portion of a dielectric portion to have a shape corresponding to the protrusion bump.

The ground portion may further include a ground insertion portion which is inserted into the housing insertion hole; a ground elastic portion which upwardly extends from the ground insertion portion and in which at least three slits are formed along a periphery so as to have an elastic force; and a ground contact portion which extends from the ground elastic portion and comes into contact with the ground electrode of the board.

The board-mating connector may further include an elastic bending portion which is bent from the ground contact portion and extends in a direction opposite to an extension direction of the ground contact portion.

The board-mating connector may further include an elastic restriction portion which is bent from the elastic bending portion and extends in a direction opposite to an extension direction of the elastic bending portion.

The ground elastic portion may include a first elastic portion which is bent and extends from the ground insertion portion; and a second elastic portion which is bent and upwardly extends from the first elastic portion.

An extension direction of the first elastic portion may be perpendicular to an extension direction of the ground insertion portion.

The board-mating connector may further include a ground switch portion that switches an extension direction of the first elastic portion from an outside to an inside of the ground insertion portion between the ground insertion portion and the first elastic portion.

The first elastic portion and the second elastic portion may extend inside the ground insertion portion.

The board-mating connector may further include an insertion protrusion portion which is formed to protrude to an inside on a periphery of the ground insertion portion.

The board-mating connector may further include a cover portion which is located between the ground portion and the housing insertion hole.

The board-mating connector may further include a cover fitting portion which is bent outward a lower end of the ground insertion portion and into which a lower end of the cover portion is inserted.

The signal portion may include a signal body portion in which a body insertion hole having one side opened is formed; a signal contact portion in which a contact insertion hole having the other side opened is formed; and a signal spring which is inserted between the one side of the body insertion hole and the other side of the contact insertion hole. A part of one side of the signal contact portion may be inserted into the body insertion hole. In a state where the signal spring is compressed, an outside of the signal contact portion may come into contact with an inside of the signal body portion so as to electrically connect the signal body portion to the signal contact portion.

The board-mating connector may further include a contact protrusion portion which is formed to protrude from an outer wall of the other end of the signal contact portion; and at least three contact slits which are elongated toward one side from the other side of the signal contact portion and are formed along a periphery of the signal contact portion.

The board-mating connector may further include a body protrusion portion which is formed to protrude from an inner wall of the signal body portion; and a contact groove formed in an annular shape along a periphery of the signal contact portion such that an up-and-down movement of the signal contact portion is guided by inserting the body protrusion portion into the contact groove, when the signal spring is compressed and recovered.

Advantageous Effects

First, since a housing insertion hole is formed in a housing portion and a board-mating connector is inserted into the housing insertion hole, a coupling height may be reduced, and thereby, there is an effect that a thickness of a module to which a board-mating connector is applied is reduced.

In addition, a hook bump is hooked on a protrusion bump to limit a depth of insertion of a board-mating connector into a housing insertion hole, and thus, there is an effect that a gap between an end of a signal portion and a signal electrode coming into contact with the one end is adjusted.

In addition, since an elastic bending portion is formed to prevent a ground electrode from directly coming into contact with an end of a ground contact portion, a ground electrode is prevented from being damaged, and further, an elastic force is improved.

In addition, if an excessive force is applied to a ground portion, an elastic restriction portion is prevented from being deformed further due to contact with other structures, and thus, there is an effect that the ground portion is prevented from being deformed.

In addition, a first elastic portion and a second elastic portion disperse a stress applied to a ground elastic portion, and thus, there is an effect that a ground portion is prevented from being deformed.

In addition, since a first elastic portion extends in a horizontal direction to operate, there is an effect that a coupling height is reduced.

In addition, a first elastic portion and a second elastic portion disperse a stress applied to a ground elastic portion, and thus, there is an effect that a ground portion is prevented from being deformed.

In addition, since an insertion protrusion portion is in close contact with a housing to minimize a free space between a ground portion and a housing, there is an effect that a board-mating connector may be prevented from swinging.

In addition, since a cover portion surrounds the outside of a ground portion, there is an effect that a board-mating connector is prevented from being damaged when the ground portion is inserted into a housing insertion hole.

In addition, since a lower end of a cover portion is inserted into a cover fitting portion, there is an effect that a coupling force between a ground portion and the cover portion is increased by preventing the cover portion from swinging.

In addition, since generation of a free space is minimized, there is an effect that a board-mating connector is prevented from swinging.

In addition, since a signal body portion and a signal contact portion are electrically connected to each other, a signal portion according to the present invention has an effect that PIMD characteristics are improved.

BRIEF DESCRIPTION OF DRAWINGS

FIG. 1 is a sectional view illustrating a first embodiment according to the present invention.

FIG. 2 is a sectional view illustrating a second embodiment according to the present invention.

FIG. 3 is a sectional view illustrating a third embodiment according to f the present invention.

FIG. 4 is a perspective view illustrating the third embodiment according to the present invention.

FIG. 5 is a sectional view illustrating a fourth embodiment according to the present invention.

FIG. 6 is a perspective view illustrating the fourth embodiment according to the present invention.

FIG. 7 is a sectional view illustrating a fifth embodiment according to the present invention.

FIG. 8 is a perspective view illustrating the fifth embodiment according to the present invention.

FIG. 9 is a sectional view illustrating a signal portion according to the present invention.

FIG. 10 is a cross-sectional view illustrating a compressed state of the signal portion according to the present invention.

DESCRIPTION OF EXEMPLARY EMBODIMENTS

In order to facilitate understanding of a board-mating connector with a reduced coupling height according to the present invention, each of characteristics will be first described as follows.

First, the first embodiment is characterized in that a dielectric portion 300 is spaced apart from a ground portion 200 and is located between a signal portion 100 and a housing portion 400.

In addition, second to fifth embodiments are characterized in that the dielectric portion 300 is located between the signal portion 100 and the ground portion 200.

In addition, the first to fifth embodiments are characterized in that the embodiments are each distinguished according to a shape of the ground portion 200.

That is, it is characterized that the first embodiment is a basic embodiment, a ground elastic portion 220 includes a first elastic portion 221 and a second elastic portion 222 in the second to fifth embodiments, the second embodiment further includes an elastic restriction portion 250, and the fourth embodiment further includes a ground switch portion 260.

In addition, the ground elastic portion 220 extends to the outside of the ground insertion portion 210 in the first to third embodiments, and the ground elastic portion 220 extends to an inside of the ground insertion portion 210 in the fourth and fifth embodiments.

In addition, it is characterized that the third and fourth embodiments further include a cover portion 500.

In the following description, elements that may be derived from the above-described embodiments will be described to facilitate understanding.

In addition, an example similar to the embodiment described above may be derived by a combination of elements which will be described below, or a new embodiment may be derived by adding an element to or removing the element from the above-described embodiment.

Since the board-mating connector increases a coupling height between an upper board and a lower board, there is a problem that a thickness of a module including the board-mating connector is increased.

In order to solve the problem, the board-mating connector with a reduced coupling height according to the present invention includes the signal portion 100, the ground portion 200, the housing portion 400, the housing insertion hole 410, and the dielectric portion 300 as illustrated in FIGS. 1 to 8.

One side of the signal portion 100 is in contact with a signal electrode of the board and is electrically connected to the signal electrode.

One side of the ground portion 200 is in contact with a ground electrode of the board and is electrically connected to the ground electrode, and a hollow is formed inside.

In addition, the ground portion 200 may be formed by bending a metal plate into a cylindrical shape instead of metal processing.

The housing insertion hole 410 is formed in the housing portion 400 such that the signal portion 100 and the ground portion 200 are inserted.

In the housing portion 400, the entire portion in contact with the ground portion 200 is formed of metal, or at least a part of the portion in contact with the ground portion 200 is formed of metal.

At this time, the metal may be electrically connected to the ground portion 200 by selecting a conductive material as the metal.

The dielectric portion 300 is inserted into the housing insertion hole 410 and is located between the signal portion 100 and the housing portion 400 such that the signal portion 100 is spaced apart from the ground portion 200 and the housing portion 400.

At this time, the dielectric portion 300 may be spaced apart from the ground portion 200 and be located between the signal portion 100 and the housing portion 400 as illustrated in FIG. 1, or may be located between the signal portion 100 and the housing portion 400 as illustrated in FIGS. 2 to 8.

As described above, since the housing insertion hole 410 is formed in the housing portion 400 and the board-mating connector is inserted into the housing insertion hole 410, a coupling height may be reduced, and thereby, there is an effect that a thickness of a module to which the board-mating connector is applied is reduced.

The board-mating connector with a reduced coupling height according to the present invention further includes a hook bump 301 and a protrusion bump 411 as illustrated in FIGS. 1 to 8.

The protrusion bump 411 is formed to protrude from the housing portion 400 to the inside of the housing insertion hole 410.

The hook bump 301 formed by reducing a diameter of a lower portion of the dielectric portion 300 has a shape corresponding to the protrusion bump 411.

At this time, in the embodiment in which the dielectric portion 300 is located between the signal portion 100 and the ground portion 200, when the ground portion 200 is located between the hook bump 301 and the protrusion portion 411, a free space is formed therein, and thereby, the board-mating connector may swing as illustrated in FIGS. 2 to 8.

Therefore, the ground portion 200 is formed only on the outer side of an upper portion of the dielectric portion 300 with the hook bump 301 as the center and is not formed on the outer side of a lower portion of the dielectric portion 300, and thus, it is preferable that the dielectric portion 300 is in direct face-to-face contact with the housing portion 400.

As described above, the hook bump 301 is hooked on the protrusion bump 411 to limit a depth of the housing insertion hole 410 into which the board-mating connector is inserted, and thus, there is an effect that a gap between an end of the signal portion 100 and a signal electrode coming into contact with the one end is adjusted.

The ground portion 200 of the board-mating connector with a reduced coupling height according to the present invention further includes a ground insertion portion 210, the ground elastic portion 220, and a ground contact portion 230 as illustrated in FIGS. 1 to 8.

The ground insertion portion 210 is inserted into the housing insertion hole 410.

The ground elastic portion 220 upwardly extends from the ground insertion portion 210, and at least three slits are formed along a periphery so as to have an elastic force.

The ground elastic portion 220 is divided into three or more portions by the slits and is elastic when coming into contact with the ground electrode.

The ground contact portion 230 extends from the ground elastic portion 220 and is in contact with the ground electrode of the board.

There is a problem that the ground electrode damages an end of the ground contact portion 230 when the ground electrode directly come into contact with the end of the ground contact portion 230.

In order to solve this problem, the board-mating connector with a reduced coupling height according to the present invention further includes an elastic bending portion 240 as illustrated in FIGS. 2 to 8.

The elastic bending portion 240 is bent from the ground contact portion 230 and extends in a direction opposite to the extension direction of the ground contact portion 230.

That is, since the elastic bending portion 240 is formed at the end of the ground contact portion 230, a surface not the end of the ground contact portion 230 comes into contact with the ground electrode.

As described above, since the elastic bending portion 240 is formed to prevent the ground electrode from directly coming into contact with the end of the ground contact portion 230, the ground electrode is prevented from being damaged, and further, the elastic force is improved.

There is a problem that the ground portion 200 may be deformed if an excessive force is applied to the ground portion 200.

In order to solve the problem, the board-mating connector with a reduced coupling height according to the present invention further includes an elastic restriction portion 250 as illustrated in FIG. 2.

The elastic restriction portion 250 is bent from the elastic bending portion 240 and extends in a direction opposite to the extension direction of the elastic bending portion 240.

As a force applied to the ground portion 200 increases, the elastic restriction portion 250 comes closer to the ground elastic portion 220, and if an excessive force is applied to the ground portion 200, the elastic restriction portion 250 comes into contact with the ground elastic portion 220, and thereby, deformation of the ground elastic portion 220 is restricted.

As described above, if the excessive force is applied to the ground portion 200, the elastic restriction portion 250 is prevented from being deformed further due to contact with other structures, and thus, there is an effect that the ground portion 200 is prevented from being deformed.

The ground elastic portion 220 of the board-mating connector with a reduced coupling height according to the present invention may further include a first elastic portion 221 and a second elastic portion 222 as illustrated in FIGS. 2 to 8.

The first elastic portion 221 is bent and extends from the ground insertion portion 210.

The second elastic portion 222 is bent and upwardly extends from the first elastic portion 221.

As described above, the first elastic portion 221 and the second elastic portion 222 disperse a stress applied to the ground elastic portion 220, and thus, there is an effect that the ground portion 200 is prevented from being deformed.

At this time, as illustrated in FIGS. 2 to 6, an extension direction of the first elastic portion 221 may be formed perpendicular to the extension direction of the ground insertion portion 210.

As described above, since the first elastic portion 221 extends in a horizontal direction to operate, there is an effect that a coupling height is reduced.

In addition, as illustrated in FIGS. 7 and 8, the first elastic portion 221 and the second elastic portion 222 extend to the inside of the ground insertion portion 210 such that the ground portion 200 extends in a vertical direction in general, or the ground portion 200 may further include a ground switch portion 260 such that the ground portion 200 extends in a vertical direction in general as illustrated in FIGS. 5 and 6.

The ground switch portion 260 switches the extension direction of the first elastic portion 221 from the outside to the inside of the ground insertion portion 210 between the ground insertion portion 210 and the first elastic portion 221.

Specifically, the ground switch portion 260 extends from the ground insertion portion 210 and is bent so as to be perpendicular to the ground insertion portion 210, extends in a direction opposite to the extension direction, and is switched from the outside to the inside of the first elastic portion 221.

As described above, since the first elastic portion 221 and the second elastic portion 222 disperse the stress applied to the ground elastic portion 220, there is an effect that the ground portion 200 is prevented from being deformed.

The board-mating connector with a reduced coupling height according to the present invention further includes an insertion protrusion portion 211 as illustrated in FIGS. 2, 7, and 8.

The insertion protrusion portion 211 is formed to protrude from the ground insertion portion 210 toward the inside.

As described above, since the insertion protrusion portion 211 is in close contact with a housing to minimize a free space between the ground portion 200 and the housing, there is an effect that the board-mating connector may be prevented from swinging.

There is a problem that the board-mating connector is damaged when the board-mating connector is inserted into the housing insertion hole 410.

In addition, there is a problem that a space is formed when the board-mating connector is inserted into the housing insertion hole 410 causing the board-mating connector to swing.

In order to solve the problems, the board-mating connector with a reduced coupling height according to the present invention further includes a cover portion 500 as illustrated in FIGS. 3 to 6.

The cover portion 500 is located between the ground portion 200 and the housing insertion hole 410.

As illustrated in FIGS. 5 and 6, a cover fitting portion 212 is bent outward at a lower end of the ground insertion portion 210, and thereby, a lower end of the cover portion 500 is inserted thereinto.

One or more the cover fitting portions 212 are formed along a periphery of the lower end of the ground insertion portion 210, make an outer surface of the ground insertion portion 210 come into close contact with an inner surface of the cover portion 500, and make the cover portion 500 be spaced apart from the housing insertion hole 410.

In a case where the ground portion 200 is formed by bending a metal plate into a cylindrical shape, the ground portion 200 may be damaged when being inserted into the housing insertion hole 410 because the ground portion 200 is thin.

At this time, the cover portion 500 surrounds the outside of the ground portion 200 to reinforce a thin thickness of the ground portion 200, thereby, preventing the ground portion 200 from being damaged when the ground portion 200 is inserted into the housing insertion hole 410.

As described above, since the cover portion 500 surrounds the outside of the ground portion 200, there is an effect that the board-mating connector is prevented from being damaged when the ground portion 200 is inserted into the housing insertion hole 410.

In addition, since generation of a free space is minimized, there is an effect that the board-mating connector is prevented from swinging.

In addition, since a lower end of the cover portion 500 is inserted into the cover fitting portion 212, there is an effect that a coupling force between the ground portion 200 and the cover portion 500 is increased by preventing the cover portion 500 from swinging.

When a signal body portion 110 is electrically connected to a signal contact portion 120 through a signal spring 130, there is a problem that PIMD characteristics are poor.

In order to solve the problem, the signal portion 100 of the board-mating connector with a reduced coupling height according to the present invention further includes the signal body portion 110, the signal contact portion 120, the contact protrusion portion 122, a contact slit 123, a body protrusion portion 112, and a contact groove 124 as illustrated in FIGS. 9 and 10.

A body insertion hole 111 in which one side thereof is opened is formed inside the signal body portion 110.

A contact insertion hole 121 in which the other side thereof is opened is formed inside the signal contact portion 120.

The signal spring 130 is inserted between the one side of the body insertion hole 111 and the other side of the contact insertion hole 121.

A part of one side of the signal contact portion 120 is inserted into the body insertion hole 111, At this time, in a state where the signal spring 130 is compressed, the outside of the signal contact portion 120 comes into contact with the inside of the signal body portion 110, and thereby, the signal body portion 110 is electrically connected to the signal contact portion 120.

The contact protrusion portion 122 is formed to protrude from an outer wall of the other end of the signal contact portion 120.

The contact slit 123 is elongated from one end to the other end of the signal contact portion 120, and at least three contact slits 123 are formed along a periphery of the signal contact portion 120.

The body protrusion portion 112 is formed to protrude from an inner wall of the signal body portion 110.

The contact groove 124 is formed in an annular shape along a periphery of the signal contact portion 120 such that an up-and-down movement of the signal contact portion 120 is guided by inserting the body protrusion portion 112 into the contact groove 124, when the signal spring 130 is compressed and recovered.

As described above, since the signal body portion 110 and the signal contact portion 120 are electrically connected to each other, the signal portion 100 according to the present invention has an effect that PIMD characteristics are improved.

Reference Signs List

| | |
|---|---|
| 100 signal portion | 110 signal body portion |
| 111 body insertion hole | 112 body protrusion portion |
| 120 signal contact portion | 121 contact insertion hole |
| 122 contact protrusion portion | 123 contact slit |
| 124 contact groove | 130 signal spring |
| 200 ground portion | 210 ground insertion portion |
| 211 insertion protrusion portion | 212 cover fitting portion |
| 220 ground elastic portion | 221 first elastic portion |
| 222 second elastic portion | 230 ground contact portion |

-continued

| Reference Signs List | |
|---|---|
| 240 elastic bending portion | 250 elastic restriction portion |
| 260 ground switch portion | 300 dielectric portion |
| 301 hook bump | 400 housing portion |
| 410 housing insertion hole | 411 protrusion bump |
| 500 cover portion | |

What is claimed is:

1. A board-mating connector with a reduced coupling height comprising:

a signal portion having one side in contact with a signal electrode of a board and to be electrically connected to the signal electrode;

a ground portion having one side in contact with a ground electrode of the board to be electrically connected to the ground electrode and having a hollow inside;

a housing portion in which a housing insertion hole is formed such that the signal portion and the ground portion are inserted thereinto and in which at least a part of a portion coming into contact with the ground portion is formed of metal;

a dielectric portion which is inserted into the housing insertion hole and is located between the signal portion and the housing portion such that the signal portion is spaced apart from the ground portion and the housing portion;

a protrusion bump which is formed to protrude from the housing portion toward an inside of the housing insertion hole; and a hook bump which is formed by reducing a diameter of a lower portion of a dielectric portion to have a shape corresponding to the protrusion bump.

2. The board-mating connector with a reduced coupling height of claim 1, wherein the ground portion further includes a ground insertion portion which is inserted into the housing insertion hole; and wherein the board-mating connector further comprises an insertion protrusion portion which is formed to protrude to an inside on a periphery of the ground insertion portion.

3. A board-mating connector with a reduced coupling height comprising:

a signal portion having one side in contact with a signal electrode of a board and to be electrically connected to the signal electrode;

a ground portion having one side in contact with a ground electrode of the board to be electrically connected to the ground electrode and having a hollow inside;

a housing portion in which a housing insertion hole is formed such that the signal portion and the ground portion are inserted thereinto and in which at least a part of a portion coming into contact with the ground portion is formed of metal;

a dielectric portion which is inserted into the housing insertion hole and is located between the signal portion and the housing portion such that the signal portion is spaced apart from the ground portion and the housing portion;

wherein the ground portion further includes:

a ground insertion portion which is inserted into the housing insertion hole, a ground elastic portion which upwardly extends from the ground insertion portion and in which at least three slits are formed along a periphery so as to have an elastic force, and a ground contact portion which extends from the ground elastic portion and comes into contact with the ground electrode of the board; and an elastic bending portion which is bent from the ground contact portion and extends in a direction opposite to an extension direction of the ground contact portion.

4. The board-mating connector with a reduced coupling height of claim 3, further comprising:

an elastic restriction portion which is bent from the elastic bending portion and extends in a direction opposite to an extension direction of the elastic bending portion.

5. A board-mating connector with a reduced coupling height comprising:

a signal portion having one side in contact with a signal electrode of a board and to be electrically connected to the signal electrode;

a ground portion having one side in contact with a ground electrode of the board to be electrically connected to the ground electrode and having a hollow inside;

a housing portion in which a housing insertion hole is formed such that the signal portion and the ground portion are inserted thereinto and in which at least a part of a portion coming into contact with the ground portion is formed of metal; and a dielectric portion which is inserted into the housing insertion hole and is located between the signal portion and the housing portion such that the signal portion is spaced apart from the ground portion and the housing portion;

wherein the ground portion further includes:

a ground insertion portion which is inserted into the housing insertion hole, a ground elastic portion which upwardly extends from the ground insertion portion and in which at least three slits are formed along a periphery so as to have an elastic force, and a ground contact portion which extends from the ground elastic portion and comes into contact with the ground electrode of the board; and wherein the ground elastic portion includes:

a first elastic portion which is bent and extends from the ground insertion portion, and a second elastic portion which is bent and upwardly extends from the first elastic portion.

6. The board-mating connector with a reduced coupling height of claim 5, wherein an extension direction of the first elastic portion is perpendicular to an extension direction of the ground insertion portion.

7. The board-mating connector with a reduced coupling height of claim 5, further comprising:

a ground switch portion that switches an extension direction of the first elastic portion from an outside to an inside of the ground insertion portion between the ground insertion portion and the first elastic portion.

8. The board-mating connector with a reduced coupling height of claim 5, wherein the first elastic portion and the second elastic portion extend inside the ground insertion portion.

9. A board-mating connector with a reduced coupling height comprising:

a signal portion having one side in contact with a signal electrode of a board and to be electrically connected to the signal electrode;

a ground portion having one side in contact with a ground electrode of the board to be electrically connected to the ground electrode and having a hollow inside;

a housing portion in which a housing insertion hole is formed such that the signal portion and the ground portion are inserted thereinto and in which at least a part of a portion coming into contact with the ground portion is formed of metal;

a dielectric portion which is inserted into the housing insertion hole and is located between the signal portion and the housing portion such that the signal portion is spaced apart from the ground portion and the housing portion; and a cover portion which is located between the ground portion and the housing insertion hole.

10. The board-mating connector with a reduced coupling height of claim 9, wherein the ground portion further includes a ground insertion portion which is inserted into the housing insertion hole; and wherein board-mating connector further comprises a cover fitting portion which is bent outward a lower end of the ground insertion portion and into which a lower end of the cover portion is inserted.

11. A board-mating connector with a reduced coupling height comprising:

a signal portion having one side in contact with a signal electrode of a board and to be electrically connected to the signal electrode;

a ground portion having one side in contact with a ground electrode of the board to be electrically connected to the ground electrode and having a hollow inside;

a housing portion in which a housing insertion hole is formed such that the signal portion and the ground portion are inserted thereinto and in which at least a part of a portion coming into contact with the ground portion is formed of metal; and a dielectric portion which is inserted into the housing insertion hole and is located between the signal portion and the housing portion such that the signal portion is spaced apart from the ground portion and the housing portion;

wherein the signal portion includes:

a signal body portion in which a body insertion hole having one side opened is formed, a signal contact portion in which a contact insertion hole having the other side opened is formed, and a signal spring which is inserted between the one side of the body insertion hole and the other side of the contact insertion hole, wherein a part of one side of the signal contact portion is inserted into the body insertion hole, and wherein, in a state where the signal spring is compressed, an outside of the signal contact portion comes into contact with an inside of the signal body portion so as to electrically connect the signal body portion to the signal contact portion.

12. The board-mating connector with a reduced coupling height of claim 11, further comprising:

a contact protrusion portion which is formed to protrude from an outer wall of the other end of the signal contact portion; and at least three contact slits which are elongated toward one side from the other side of the signal contact portion and are formed along a periphery of the signal contact portion.

13. The board-mating connector with a reduced coupling height of claim 12, further comprising:

a body protrusion portion which is formed to protrude from an inner wall of the signal body portion; and a contact groove formed in an annular shape along a periphery of the signal contact portion such that an up-and-down movement of the signal contact portion is guided by inserting the body protrusion portion into the contact groove, when the signal spring is compressed and recovered.

* * * * *